United States Patent [19]

Glover

[11] Patent Number: 4,927,056

[45] Date of Patent: May 22, 1990

[54] OIL DISPENSING SYSTEM WITH CONTROLLED METERING AND METHOD

[75] Inventor: Richard S. Glover, Hollywood, Fla.

[73] Assignee: RSL Industries, Inc., Cooper City, Fla.

[21] Appl. No.: 53,344

[22] Filed: May 22, 1987

[51] Int. Cl.[5] ..... B67D 5/16

[52] U.S. Cl. ..... 222/1; 222/23; 222/25; 222/72; 222/318

[58] Field of Search ..... 222/14, 16, 20, 23, 222/71, 72, 318, 1, 28, 21, 25, 26, 27, 32, 33, 36, 37, 73–75; 364/465, 479

[56] References Cited

U.S. PATENT DOCUMENTS

| | | | |
|---|---|---|---|
| 3,040,573 | 6/1962 | Berck | 222/72 X |
| 3,083,874 | 4/1963 | Richards | 222/72 X |
| 3,147,884 | 9/1964 | Sacco | 222/72 X |
| 3,159,310 | 12/1964 | Rafferty | 222/72 X |
| 3,266,425 | 8/1966 | Brunson | 222/72 |
| 3,854,038 | 12/1974 | McKinley | 364/510 |
| 3,887,110 | 6/1975 | Porter | 222/16 |
| 3,895,529 | 7/1975 | Moore | 364/510 |
| 4,009,800 | 3/1977 | Loy et al. | 222/28 |
| 4,051,998 | 10/1977 | Zabel | 222/23 |
| 4,074,356 | 2/1978 | Schiller et al. | 222/23 X |
| 4,442,953 | 4/1984 | Miyamoto et al. | 222/14 |
| 4,467,657 | 8/1984 | Olsson | 73/861 |
| 4,542,836 | 9/1985 | Sparks et al. | 222/27 |
| 4,637,525 | 1/1987 | Miura et al. | 222/22 |

FOREIGN PATENT DOCUMENTS

| | | | |
|---|---|---|---|
| 58-82123 | 5/1983 | Japan | 222/23 |

*Primary Examiner*—Kevin P. Shaver

*Attorney, Agent, or Firm*—Robert C. Kain, Jr.

[57] ABSTRACT

In one embodiment, the high viscosity fluid to be metered and dispensed is oil that is pumped at a low flow rate, in the range of one quart per minute. A positive displacement pump obtains the oil from a tank and pumps the oil to an air eliminator. A volumetric meter is downstream of the air eliminator and receives the oil therefrom via a hydraulic system line. An electronic detector/pulser produces signals based upon the flow of oil through the meter. In a working embodiment, 1,000 pulses represent one quart of oil. These pulses are applied to a controller which includes an adjustable calibration circuit that corrects for system characteristics in order to dispense a "legal" quart of oil to a customer. The controller has an input device and a comparator that enables the controller, after being programmed, to dispense, for example, two quarts of oil. A control signal is supplied to the pump which turns on the pump and another control signal is supplied to an ON/OFF valve near the distal end of the system line. Preferably, a high flow rate and low flow rate signal is utilized as the ON signal to a two stage solenoid valve that is the ON/OFF valve. The system line terminates at the island where the oil is dispensed by a nozzle controlled by the customer. At the distal most end of the nozzle a check valve is utilized to maintain the system integrity.

29 Claims, 1 Drawing Sheet

OIL DISPENSING SYSTEM WITH CONTROLLED METERING AND METHOD

BACKGROUND OF THE INVENTION

The present invention relates to a system for metering and dispensing, at a low flow rate, a high viscosity fluid, such as oil, and a method of metering and dispensing that high viscosity fluid.

Motor oil that is used in automobiles, trucks, boats and other machinery has a very high viscosity. As used herein, the term "high viscosity" refers to fluids having a viscosity of in the range of 100 to 3,000 s.s.u., that is second say-bolt units. Currently, persons seeking to purchase quantities of oil would buy the oil in small units such as quarts or possibly single gallons. The oil is customarily sold in cans or quart containers (or gallon containers). This method of selling oil differs considerably from the sale of other petroleum products such as gasoline. In contrast, gasoline has a very low viscosity (approximately 30–40 s.s.u.) as compared with oil. As a reference, water has a viscosity of 30 s.s.u. Because of the compression problem when the oil includes air and because of the slippage problem when the oil flows through mechanical metering device, an oil dispensing system that meets government standards to controllably deliver set quantities of oil has not been commercially developed prior to the present invention.

One prior art device utilized a suction pump and an air eliminator but did not include an electronic calibration circuit that corrects for imperfections or characteristics in the oil dispensing system. In practice, it is necessary to calibrate to legal units of measure all government approved fluid dispensing systems that dispense fluid as a saleable product to the public. For example, the sale of gasoline to the public involves calibrating the pump, meter and the various system items. Since gasoline is a low viscosity and high flow rate product, compressibility of the fluid is not critical nor is slippage of the fluid through the system lines a problem. In contrast, a high viscosity fluid, such as oil has a high degree of slippage. Therefore, it is very difficult to design and manufacture a calibratable system to ensure that a customer receives a full legal quart of oil when a quart is purchased. The present invention overcomes these difficulties.

OBJECTS OF THE PRESENT INVENTION

It is an object of the present invention to provide a system for metering and dispensing, at a low flow rate, a high viscosity fluid.

It is a further object of the present invention to provide a oil dispensing system that complies with government regulation such that oil is dispensed and sold to the public in known legal quantities.

It is an additional object in the present invention to provide a dispensing system that has a high degree (99%) of repeatability.

It is a further object of the present invention to utilize an electronic controller having an adjustable calibration device that can be calibrated to match a particular dispensing system.

It is an additional object of the present invention to provide a dispensing system that operates at a low flow rate, in the range of quarts per minute.

It is an additional object of the present invention to provide an oil dispensing system that has a high degree of integrity due to the containment of oil in sealed hydraulic system lines when the oil is not being dispensed from the system.

SUMMARY OF THE INVENTION

In one embodiment, the high viscosity fluid is oil that is pumped at a low flow rate, in the range of one quart per minute. A positive displacement pump obtains the oil from a tank and pumps the oil to an air eliminator. A volumetric meter is downstream of the air eliminator and receives the oil therefrom via a hydraulic system line. An electronic detector/pulser produces signals based upon the flow of oil through the meter. In a working embodiment, 1,000 pulses represent one quart of oil. These pulses are applied to a controller which includes an adjustable calibration circuit that corrects for system and fluid characteristics in order to dispense a "legal" quart of oil to a customer. The controller has an input device and a comparator that enables the controller to uniformly and repeatedly dispense, for example, two quarts of oil. A control signal is then supplied to the pump which turns on the pump and another control signal is supplied to an ON/OFF valve near the distal end of the system line. Preferably, a high flow rate and low flow rate signal is utilized as the ON signal and that signal is supplied to a two stage solenoid valve at the distal end of the line. The system line terminates at the island where the oil is dispensed by a controllable nozzle. At the distal most end of the nozzle a check valve is utilized to maintain the system integrity.

BRIEF DESCRIPTION OF THE DRAWING

Further objects and advantages of the present invention may be found in the detailed description of the preferred embodiments when taken in conjunction with the accompanying drawing in which:

The sole FIGURE illustrates schematically and diagrammatically the system for metering and dispensing, at a low flow rate, a high viscosity fluid such as oil.

DETAILED DESCRIPTION OF THE PREFERRED EMBODIMENTS

Figure 1:
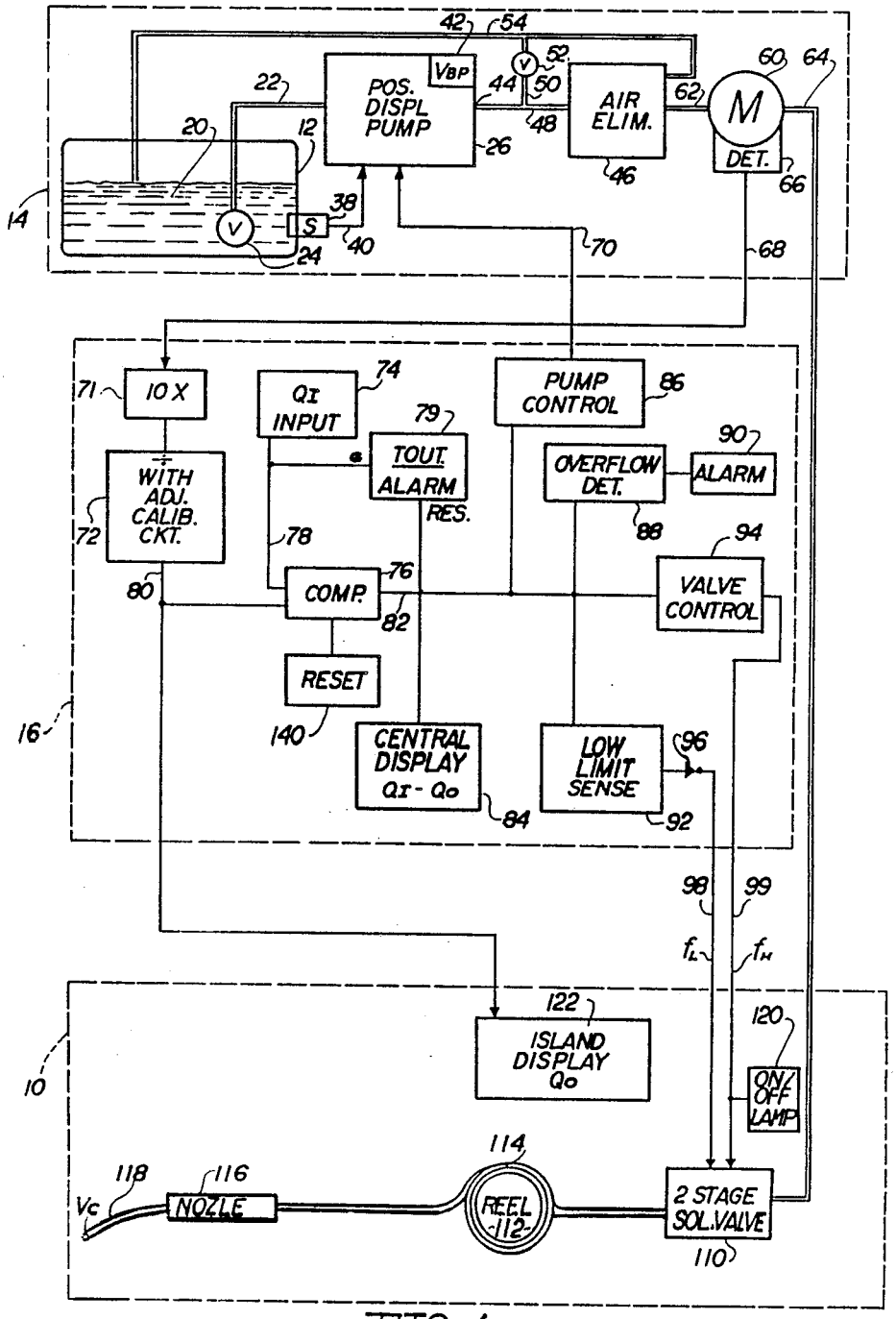

The present invention relates to a system for metering and dispensing, at a low flow rate, a high viscosity fluid, such as oil, and a method of metering and dispensing of that fluid.

The sole FIGURE illustrates, both schematically and diagrammatically, the system.

In a preferred embodiment, the system is installed in a gas station where oil is sold to customers that drive their cars up and near an island. The island typically contains gasoline pumps, miscellaneous cleaning devices for the customer, and preferably includes an island substation 10 shown in dashed lines at the bottom of the sole FIGURE.

The source of oil is a tank 12 located at a distance from island 10. The tank is generally located at pump station 14 shown at the top of the sole FIGURE. Although oil is discussed herein as being the dispensed fluid, the appended claims are not meant to be limited to an oil dispensing system since any high viscosity, low flow rate, liquid product can be dispensed using the present invention. The appended claims are meant to encompass this feature. As stated earlier, a high viscosity fluid is a fluid having a viscosity in the range of 100 to 3,000 s.s.u. The low flow rate refers to flow rates in the range of quarts per minute or in the range of 0.25 and 2.5 gallons per minute. The problems encountered with a high flow rate system are very dissimilar to the low flow rate system described herein. Specifically, metering the fluid and calibrating the systems present significant problems. The dispensing of low viscosity fluids is much easier since compressibility and slippage of the product as it flows through the system lines do not affect metering and calibration. In contrast, metering and calibration of high viscosity fluids are significantly affected by compressibility and slippage.

Returning to the gas station example, a control center 16 provides overall control of the dispensing operation from a convenient location, typically inside the gas station proper.

With respect to pump station 14, tank 12 contains a source of oil 20. Suction line or oil supply line 22 has a foot valve (V) 24 at its bottom. The purpose of foot valve 24 is to provide one-way flow from tank 12 to a positive displacement pump 26 via supply line 22. It is shown herein, the double lines illustrate hydraulic lines and the single lines illustrate electrical lines. Foot valve 24 does not permit oil in line 22 from re-entering tank 12. Preferably, seamless, steel, low pressure tubing or hydraulic piping is utilized with swage fittings between sections of the pipe. As used in the claims, the term "system line" refers to the sections of the hydraulic piping.

Tank 12 also has sensor 38 associated with it that outputs a signal on line 40 that disables pump 26 when the fluid level falls below the level of the sensor. Sensor 38 could be mechanical, electrical, or hydraulic in nature as long as pump 26 is disabled. The purpose of sensor 38 is to ensure that once the oil dispensing system is correctly calibrated, as will be described later, the system does not "pump air" into the system lines thereby eliminating the prime of the pump.

Positive displacement pump 26 has an internal bypass valve 42 that ensures that a total dynamic head is substantially constant at output port 44 of the pump. In one embodiment, pump 26 produces 50 psi at output 44 at 1.7 gallons per minute flow. The pump preferably is driven by ½ horse power, explosion proof motor. In one working embodiment, the pump head is a model LEV pump made by Tuthill of Ft. Wayne, Ind. This pump head has a built in, adjustable bypass relief valve such that the pressure at the output of the pump can be set.

Immediately downstream of pump 26 is an air eliminator 46. The term "downstream" refers to the flow of oil from the source (tank 12) to other items away from the source. Therefore, since the oil is pumped from tank 12 to air eliminator 46, via system section line 48, the air eliminator is downstream of the pump. Interposed between pump 26 and air eliminator 46 is a bypass branch line 50 leading to a bypass valve 52. In one working embodiment, bypass valve 52 is a pressure relief valve that enables oil to escape from the system due to heat expansion. The heat expansion of the oil can be significant at this point in the system since air still remains in the oil line and since in tropic or subtropic environments, oil in tank 12 can be at much lower temperatures as compared with oil exposed to the environment above ground. Typically, most of the items at pump station other than tank 12 are located above ground on a concrete platform. When the oil in subsection line 48 reaches a predetermined pressure, valve 52 opens and a certain amount of oil enters return line 54. Valve 52 also is utilized in case the float in air eliminator 46 implodes or sticks.

Additionally, return line 54 is coupled to the air output for air eliminator 46. As used herein, the "air" output from air eliminator 46 can be a combination of air plus oil, i.e., aerated oil, or simply be air. This "air" could include other types of gasses and hence the term is not limited to air that is suitable for breathing by humans. Return line 54 leads back to tank 12. It is possible that the air from air eliminator 46 can be vented to atmosphere, but preferably the air is recycled back to tank 12.

Downstream of air eliminator 46 is a volumetric meter 60. The meter measures flow through the system line and particularly measures the flow between subsection line 62 and main section line 64. In one working embodiment, a LC meter model M-5 is utilized. This meter is manufactured by Liquid Controls Corporation of North Chicago, Ill. Attached to the meter is a detector 66 that generates a pulse train of signals and applies the pulse train to electrical line 68. In the industry, detector 66 is known as a pulser. This M-5 meter from Liquid Controls is modified by removing the mechanical register, that typically displays the flow through the meter, and also removing the gear train coupled to that mechanical register. Detector 66, in this embodiment, is a Veeder-pulser and is a photo-optic device. The pulser preferably generates 1,000 pulses per quart of fluid flow through meter 60. Normally, meter M-5 from Liquid Controls generates 10 pulses per quart (or one pulse per quart if set appropriately). For the present invention, i.e., the low flow application, the meter is modified by adding the Veeder-pulser (detector 66) that monitors a mechanical bladder internal to the meter by a photo-optic device and generates 1,000 pulses per quart on electrical line 68. It was necessary to modify the meter in order to obtain precise metering of this low flow rate.

Another electrical line 70 leads to pumping station 14. This line carries the enable electrical signal for pump 26. Generally, when an appropriate electrical signal is placed on line 70, pump 26 is turned on. Electrical lines 68 and 70 are not the only electrical lines leading to the pump station. Other electrical lines do run to the pump station, such as power and possibly monitoring lines, but these lines are known to persons of ordinary skill in the art and are not described herein. All the electrical lines running to pumping station 14 and also running to island 10 are disposed in explosion proof electrical conduits and are appropriately grounded and coaxially sealed therein since this dispensing system is used in gas stations.

Detector/pulser 66 outputs a generally square wave signal whose frequency varies dependent upon the metered flow through meter 60. Therefore, this electrical signal is a variable, periodic signal. In order to accommodate the low flow rate, the pulsing signal must be at least two orders of magnitude larger than a customary dispensing unit of volume of the fluid. The term "two orders of magnitude larger" refers to a signal that is in the range of at least 100 times that of the volume sought to be measured. The term "customary dispensing unit of volume" refers to that unit that a customer normally recognizes. In the case of motor oil, customers normally purchase such oil by the quart and hence the customary dispensing unit of volume is the quart. For gasoline, that unit is a gallon. Two orders of magnitude larger than the quart means that at least 100 or more pulses must represent the flow of one quart. As stated earlier, the pulse signal is three orders of magnitude larger than the customary dispensing unit of volume, that is 1,000 pulses represent one quart of oil.

One of the important features of the present invention is the electronic metering and calibration system that is present in control center or controller 16. In this embodiment, the controller is an EBU series (electronic batching unit), solid state, batch controller manufactured by S. J. Controls of Long Beach, Calif. The incoming pulses are multiplied ten times by multiplier 71. The controller could be programmed or set to multiply the incoming pulses by 1, 10, 100, or 1,000. The multiplied pulses are then divided down by divider 72 by any number from 1 to 9999. This last component is a field adjustable scaler or calibrator that enables the system to be adjusted to measure within 0.1% of the dispensed product. In other words, the pulses are corrected to account for system characteristics such as pressure variations at the pump head, in air eliminator 46, the attributes of meter 60 and detector 66, slippage and compression in through main system section line 64 and other system factors affecting the quantity of oil dispensed such as the nozzle at the distal end of the system line.

Adjustable calibration circuit 72 is set in the field after the system has been primed by dispensing a certain amount of oil from the nozzle at the island 10. An iterative process is utilized to adjust calibration circuit 72 such that one quart of oil is dispensed from the nozzle in accordance with the control input that will be described later.

The controller 16 includes an input device 74 that allows the operator to input a quantity of oil to be dispensed, that quantity of oil is designated herein as $Q_I$. Once $Q_I$ has been input into the controller, a representative value is applied to one of the inputs of comparator 76 via electrical line 78. The other input of comparator 76 is applied with the corrected signal from line 80. That signal is corrected by calibration circuit 72 and is ultimately based upon the pulse train signal on line 68. Of course, if comparator 76 is analog in nature, the signal on line 78 from input device 74 as well as the signal on line 80 from adjustable calibration circuit 72 would have to be analog in nature. However, controller 16 in the working embodiment is a solid state device and hence the signals on line 78 and 80 are digital in nature. Therefore, the FIGURE shows the controller in schematic of functional, block diagram form.

Input device 74 is also coupled to time out circuit ($t_{out}$) 79. Basically, when value $Q_I$ is input into the controller, an enable signal e is applied to time out circuit 79. If no oil or product is dispensed within a predetermined time period, such as 13 seconds, an alarm is sounded or indicated on the central controller. The time out period is adjustable. Therefore, time out circuit 79 is shown as including an alarm. The time out circuit senses when the product is dispensed since the output of comparator 76 on line 82 varies from a base line, such as 0 volts, when $Q_I$ is input into the system. The output of comparator 76 is applied to reset input of the time out circuit 79. The output of comparator 76 is also applied to central display 84. Generally, central display 84 displays a countdown quantity that is the difference between the input quantity $Q_I$ versus the output quantity or the dispensed quantity $Q_0$. Therefore, comparator 76 produces a difference signal based upon these two values. Generally speaking, the dispensed quantity signal $Q_0$ is present on line 80.

The signal on line 82 also actuates a pump control circuit 86 that generates a ON signal on line 70 that actuates pump 26. Of course, pump control circuit 86 could be a signal conditioner or could be a solenoid that actuates a different level signal in order to turn on the pump. The output of the comparator is also coupled to overflow detector circuit 88 to insure that the system does not dispense more oil than controllably input by $Q_I$ at input device 74. In other words, in an analog sense, if the output from comparator 76 becomes negative, overflow detector 88 detects this negative signal on line 82 and alarm 90 is actuated. Alarm 90 could be audio, visual or otherwise.

The output of comparator 76 is also coupled to low limit sense circuit 92 and valve control circuit 94. The low limit sense circuit determines when the value on line 78 falls below a predetermined threshold and generates a high signal at its output. The predetermined threshold is adjustable. This high signal is inverted by inverter 96 and applied to line 98. The output of valve control circuit 94 is applied to line 99. These two electrical signals on lines 98 and 99, signal not $f_L$ and signal $f_H$, are utilized in this embodiment to actuate a two state solenoid valve on island 10. As will be described later, these two signals are the high flow rate signal ($f_H$) and the low flow rate signal (not $f_L$). These last three components could contain signal conditioners or actuator circuits that provide control voltages to the two stage solenoid valve.

The three electrical signals supplied to island 10 are the quantity dispensed signal $Q_0$, the low flow rate signal (not $f_L$) on line 98 and the high flow rate signal ($f_H$) on line 99. As stated earlier, these signals are conveyed to island 10 in explosion proof electrical casings and are grounded and coaxially shielded to prevent explosions. Other signals or electrical wiring may be necessary to control or power the items on island 10, but these further signals and supplies are known to persons of ordinary skill in the art.

The hydraulic portion of island 10 includes an ON/-OFF valve, that is in this embodiment a two stage solenoid valve 110, a reel 112, that has on it long flexible hydraulic tubing 114, and nozzle 116 at the distal end of the system line.

Valve 110 is an ON/OFF valve that is turned on when a customer seeks to dispense oil from nozzle 116. In this embodiment, the two stage solenoid valve permits a high flow rate of oil through nozzle 116 for quantities of oil above a predetermined threshold, and permits a second, low flow rate of oil through the nozzle when the quantity of oil to be dispensed ($Q_I$-$Q_0$) is below the threshold. In a working embodiment, the valve is a two-way, three position single solenoid valve manufactured by Automatic Switch Company of Florham Park, N.J. This valve operates as shown in Table I.

TABLE I

| SIGNAL | | FLOW RATE |
|---|---|---|
| $f_H$ | not $f_L$ | THROUGH VALVE |
| low | low | 0 (closed) |
| low | high | 0 |
| high | low | X % (partially open) |
| high | high | 100% (fully open) |

Nozzle 116 is a controllable dispensing nozzle actuated by the customer at island 10. At the distal most end of nozzle 116 is stem 118 and at its end is a check valve $V_c$. Basically, when the customer actuates nozzle 116, pressure is built up in stem 118, and check valve $V_c$ opens and oil is dispensed by the system. When the customer closes nozzle 116, the pressure is lowered and check valve $V_c$ closes. Check valve $V_c$ and foot valve 24, in tank 12 at pumping station 14, insures system integrity and a contained or completely closed hydraulic system when the system is not dispensing oil. The system is sealingly closed at the proximal end and the distal end when the system is not dispensing oil. This is important for repeatability. In other words, once the oil is pumped from the tank, the oil remains in the system (unless evacuated due to unacceptability high pressure via pressure relief bypass valve 52) and therefore the dispensing system has high repeatability, great accuracy, and complies with government regulations relating to the dispensing of liquid products.

In order to notify the customer proximate island 10 that the central control unit 16 has accepted his order to dispense oil, an ON/OFF lamp 120 senses signal $f_H$ on electrical line 99 and turns on to indicate that the customer can dispense oil via controllable nozzle 116. Also to enable the customer to determine the amount of oil dispensed, an island display device 122 displays the quantity of dispensed oil $Q_0$.

It should be noted that various components of the oil dispensing system specifically described herein are only exemplary in nature. The important features of the system are the air elimination mechanism, the metering mechanism that produces an electrical signal, and the adjustable means for correcting the electrical signal based upon the earlier calibration of the system. As stated earlier, the system is calibrated by dispensing an approximate quart of oil via nozzle 116, adjusting calibration circuit 72 to obtain a better approximation, dispensing another quantity (hopefully closer to a "legal" quart) of oil, and further adjusting calibration circuit 72, until the dispensed quantity of oil exactly equals one quart or comes within a government prescribed tolerance equalling a quart. If an overflow is detected or a mistake is made by the customer, the central controller 16 includes reset mechanism 140 that resets comparator 76. It is to be noted that central controller 76 can be configured as a completely solid state device utilizing a central processing circuit (CPU), random access memory, read only memory, bus lines, digital circuitry, digital to analog converters and other such components. Also, control unit 16 could be completely analog in nature. The block diagram of the unit is presented herein only to such a degree that a person of ordinary skill in the art could make and use the claimed invention. It is possible that pump 26 could be replaced by a gravity feed system if a high enough pressure head could be developed at the input of air eliminator 46.

Other pumps could be utilized as long as those pumps developed a total dynamic head that is relatively constant since it is important to maintain a prescribed pressure in the system lines, particularly the system lines 62, 64, 114 up to nozzle 116 and possibly even into stem 118. The entire system can be mounted on an alternative base and able to be located at convenient dispensing locations, i.e., the tank, pump, system lines, controller, etc., could all be mounted on a single vehicle. Alternatively, various components of the system, such as the tank and hydraulic carrying and dispensing devices, can be located on a portable skid and the controller electrically coupled to the skid but remotely disposed with respect thereto. These and other modifications are meant to be encompassed by the appended claims.

What I claim is:

1. A system for metering and dispensing at a low flow rate a high viscosity fluid from a source comprising:

means for obtaining said fluid from said source and supplying said fluid to a system line, said means for obtaining including means for maintaining a total dynamic head in said system line;

means for eliminating the air from said fluid flowing through said system line;

metering means for measuring the flow of said fluid and generating a representative electrical signal of said flow, said metering means disposed downstream of said means for eliminating with respect to the flow of said fluid through said system line;

controllable dispensing means at the end of said system line;

an adjustable means for correcting said representative signal based upon an initial calibration of said system accounting for slippage and initial pressure variations of said means for obtaining, means for eliminating, metering means and compression of said high viscosity fluid in said system line; and means for determining and displaying the quantity of fluid dispensed based upon the corrected representative signal obtained from said metering means.

2. A metering and dispensing system as claimed in claim 1 wherein said means for obtaining is a positive displacement pump.

3. A metering and dispensing system as claimed in claim 1 wherein said means for maintaining includes a pressure bypass valve.

4. A metering and dispensing system as claimed in claim 3 wherein said high viscosity fluid has a viscosity in the range of 100 to 3,000 s.s.u.

5. A metering and dispensing system as claimed in claim 4 wherein said low flow rate is in a range of 0.25 to 2.5 gallons per minute through said system line.

6. A metering and dispensing system as claimed in claim 5 wherein said high viscosity fluid is oil.

7. A metering and dispensing system as claimed in claim 6 wherein said means for obtaining is a positive displacement pump.

8. A metering and dispensing system as claimed in claim 7 wherein said dispensing means includes a one-way valve at its most distal end away from said system line.

9. A metering and dispensing system as claimed in claim 7 including a one-way valve at an intake of an intake line carrying said oil between said source and said pump.

10. A metering and dispensing system as claimed in claim 9 wherein said means for eliminating is interposed in said system line between said pump and said metering means.

11. A metering and dispensing system as claimed in claim 10 including a high pressure relief valve in said system line immediately downstream of said pump.

12. A metering and dispensing system as claimed in claim 11 including a return line coupled to an air output of said means for eliminating, said return line carrying air and aerated oil back to said source.

13. A metering and dispensing system as claimed in claim 12 wherein an output port of said high pressure relief valve is fluidically coupled to said return line.

14. A metering and dispensing system as claimed in claim 9 wherein said metering means is a volumetric metering means which generates said electrical representative signal of flow through said system line.

15. A metering and dispensing system as claimed in claim 14 wherein said electrical signal is a variable periodic signal whose frequency varies dependent upon the metered flow through said metering means.

16. A metering and dispensing system as claimed in claim 15 wherein the frequency of said periodic signal is at least two orders of magnitude larger than a customary dispensing unit of volume of said oil.

17. A metering and dispensing system as claimed in claim 16 wherein the frequency is three orders of magnitude larger than said customary dispensing unit of volume.

18. A metering and dispensing system as claimed in claim 9 wherein said pump, said means for eliminating and said metering means are disposed proximate said source of said oil; said dispensing means is disposed at the distal end of said system line away from said source, and said means for determining and means for correcting are located at a control center.

19. A metering and dispensing system as claimed in claim 18 wherein said control center includes means for inputting a predetermined quantity and generating a quantity input signal, and includes means for comparing the corrected representative signal that is a quantity dispensed signal to said quantity input signal and generating a difference signal based thereon.

20. A metering and dispensing system as claimed in claim 19 wherein said control center includes means for displaying said difference signal.

21. A metering and dispensing system as claimed in claim 9 including a controllable ON/OFF valve means for controlling the flow of said oil near the distal end of said system line upstream of said controllable dispensing means.

22. A metering and dispensing system as claimed in claim 19 including a controllable ON/OFF valve means for controlling the flow of said oil near the distal end of said system line upstream of said controllable dispensing means.

23. A metering and dispensing system as claimed in claim 22 wherein said control center includes a valve controller means for generating a ON/OFF signal based said difference signal and means for applying said ON/OFF signal to said controllable ON/OFF valve means for the control thereof, said means for applying coupling said ON/OFF signal between said control center and said ON/OFF valve means.

24. A metering and dispensing system as claimed in claim 23 including a distal display means located near said distal end of said system line for displaying the quantity of oil dispensed based upon said quantity dispensed signal and means for coupling said quantity dispensed signal from said control center to said distal display means.

25. A metering and dispensing system as claimed in claim 23 wherein said ON/OFF valve means controls flow through said system line at two predetermined rates and at a zero flow rate, said valve controller means generating a high flow rate signal when said difference signal is above a predetermined threshold and a low flow rate signal when said difference signal is below said threshold, said high and low flow rate signals and the absence of such signals being said ON/OFF signal, said ON/OFF valve means regulating the flow of oil therethrough based upon said high and low flow rate signal.

26. A system for metering and dispensing at a low flow rate a high viscosity fluid from a source comprising:

a tank for said source of high viscosity fluid;

means for obtaining said fluid from said tank and supplying said fluid to a system line, said means for obtaining including means for maintaining a total dynamic head in said system line;

means for eliminating the air from said fluid flowing through said system line;

metering means for measuring the flow of said fluid and generating a representative electrical signal of said flow, said metering means disposed downstream of said means for eliminating with respect to the flow of said fluid through said system line;

controllable dispensing means at the end of said system line;

an adjustable means for correcting said representative signal based upon an initial calibration of said system accounting for slippage and initial pressure variations of said means for obtaining, means for eliminating, metering means and compression of said high viscosity fluid in said system line; and means for determining and displaying the quantity of fluid dispensed based upon the corrected representative signal obtained from said metering means;

wherein said tank, said means for obtaining, said means for eliminating, said metering means and said controllable dispensing means are located near each other.

27. A method of metering and dispensing, at a low flow rate, a high viscosity fluid from a source comprising the steps of:

pumping said fluid from said source and maintaining a substantially constant total dynamic head of said fluid downstream from a pumping output to a dispensing port;

eliminating the air from said fluid;

hydraulically containing the deaerated fluid;

measuring the flow of said deaerated fluid while controllably dispensing said deaerated fluid at said dispensing port;

generating a signal equal to or less than one-hundreth of a customary dispensing unit of volume of said fluid during the measuring step;

correcting said signal based upon initial calibration of said pumping, eliminating, containing and measuring steps thereby accounting for slippage, initial pressure variations and compression of said high viscosity fluid; and, displaying the quantity of fluid dispensed based upon the corrected signal.

28. A method as claimed in claim 27 wherein said low flow rate is in the range of 0.25 to 2.5 gallons per minute and said viscosity is in the range of 100 to 3,000 s.s.u.

29. A method as claimed in claim 27 including the step of controllably isolating the fluid pumped from the source and the hydraulically contained fluid from the external environment when said fluid is not being dispensed.

* * * * *